United States Patent [19]

Middleton et al.

[11] 4,418,893

[45] Dec. 6, 1983

[54] WATER-COOLED REFRACTORY LINED FURNACES

[75] Inventors: John A. Middleton, Eagleville; Thomas L. O'Dwyer, Berwyn, both of Pa.

[73] Assignee: Combustion Engineering, Inc., Windsor, Conn.

[21] Appl. No.: 331,040

[22] Filed: Dec. 16, 1981

[51] Int. Cl.[3] ..... C21B 7/06; C21B 7/10; C21D 1/00

[52] U.S. Cl. ..... 266/192; 266/280; 266/900; 432/119

[58] Field of Search ..... 266/900, 190, 191, 192, 266/193, 280, 283; 432/83, 119, 252

[56] References Cited

U.S. PATENT DOCUMENTS

| | | | |
|---|---|---|---|
| 2,669,446 | 2/1954 | Doat | 266/192 X |
| 3,294,386 | 12/1966 | Willenbrock | 266/280 X |
| 3,339,904 | 9/1967 | Richards | 266/192 X |
| 3,396,959 | 8/1968 | Brown | 266/192 X |
| 3,953,007 | 4/1976 | van Laar | 266/193 |
| 4,315,775 | 2/1982 | Odle et al. | 266/900 X |

*Primary Examiner*—Brian E. Hearn
*Assistant Examiner*—David A. Hey
*Attorney, Agent, or Firm*—Richard H. Berneike

[57] ABSTRACT

The metal shell of a furnace or cupola is cooled by means of water flowing down over the exterior surface of the metal shell. In order to reduce heat loss and thus decrease the energy consumption, the interior surface of the metal shell is lined with a fired refractory shape. The thermal conductivity of the refractory material and its thickness are selected such that the amount of refractory material remaining upon reaching equilibrium conditions will be sufficient to maintain the mechanical and structural integrity of the lining. Refractory materials of different conductivities may be selected for various locations in the furnace depending upon the temperatures to be encountered.

3 Claims, 4 Drawing Figures

WATER-COOLED REFRACTORY LINED FURNACES

The present invention relates to water cooled furnaces and particularly those employed to melt some material or those in which a molten slag or metal contacts the furnace walls. Examples of such furnaces are cupolas, electric arc melting furnaces and coal gasification furnaces. The invention has particular applicability to cupolas and will be described with reference to such units.

Cupolas, which go back several centuries, were refractory lined until recent years when the water cooled cupola came into being. The primary function of the refractory material was to resist high temperature metal, slag, and combustion gases, but the refractory is also called upon to resist abrasion and thermal shock. The refractory requirements in the cupola are among the most severe encountered in metallurgical practice. It was usually necessary to repair the lining or replace portions of it daily after each eight hours of operation. This resulted in large capital investment to minimize the impact of the daily shutdown periods as well as high refractory costs. It was in view of these disadvantages that the water cooled cupola was developed. The typical water cooled cupola has a metal casing or shell which is slightly tapered inwardly towards the top of the cupola. Means are provided for supplying a stream of water to the exterior surface of this tapered section at the top whereby the water will either cascade down over the exterior surface of this shell and remove heat therefrom or in an alternative design flow thru a water jacket. In either case, the metal shell is maintained at a sufficiently low temperature of perhaps about 150 degrees fahrenheit. This results in a protective layer of frozen metal and/or slag on the interior surface of the metal shell.

Although the water cooled cupola does away with the problems associated with a refractory lining, i.e., repairing the lining daily, there is an energy penalty due to higher heat loss thru the shell. This energy penalty is paid by higher coke consumption, which decreases the iron to coke ratio. This results in a higher cost for coke, increased emissions of pollutants from the cupola (and therefore, increased pollution control equipment) as well as the waste of heat.

SUMMARY OF THE INVENTION

The present invention relates to a furnace with a combination of water cooling and a refractory lining. By using the water cooling and refractory lining in combination, the benefits of each is obtained and at the same time the disadvantages of each is overcome. More particularly, the present invention involves the refractory lining of a water cooled furnace, such as a cupola, with refractory materials selected so as to maintain a low heat loss and temperature balance for proper furnace operation and minimum refractory loss. In one modification, various refactories are selected for different elevations in the furnace to correspond to the different temperatures.

DESCRIPTION OF THE PREFERRED EMBODIMENT

The preferred embodiments of the present invention will be described with particular reference to the drawings which depict a cupola and the refractory lining materials. However, it will be understood that the invention is not limited to these particular embodiments. The invention can be applied to any furnace with a metal shell cooled by flowing water, for example, an electric arc melting furnace, a coal furnace, a coal gasification furnace or a magnetohydrodynanic unit.

Figure 1:
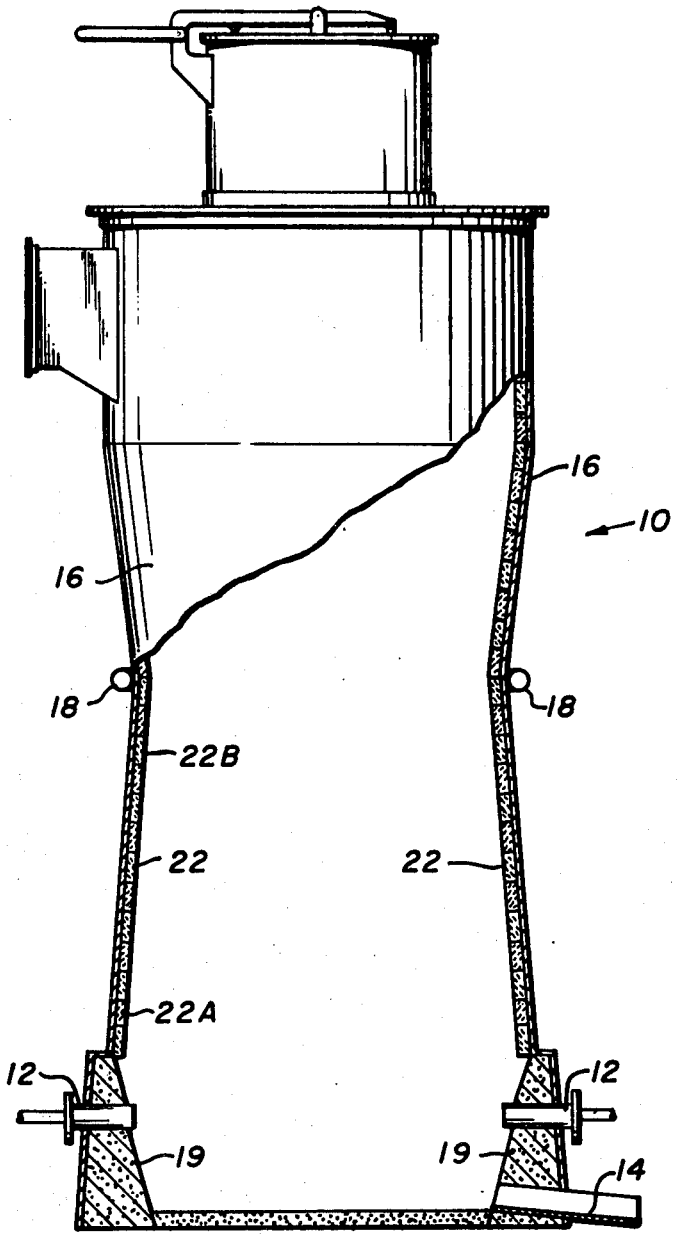
FIG. 1 illustrates a cupola in cross-sectional elevation incorporating the present invention.

FIG. 1 shows a cupola 10 which is equipped with tuyeres 12 which are located near the bottom and spaced around the periphery of the cupola. These tuyeres normally extend somewhat into the interior of the cupola and are water cooled. A tap hole 14 is provided to extract the molten metal and slag.

The basic structural component of the conventional water cooled cupola is the metal shell 16. This shell is cooled by means of water flowing downwardly over the exterior surface of the shell 16 from the header 18. Some sort of collecting through is provided near the bottom of the cupola to collect the cooling water (not shown). In such conventional water cooled cupolas, the metal shell between the header 18 and the tuyere area is unlined in contrast to the present invention wherein this section is lined with refractory material as shown in FIG. 1.

The cupola in the area of the tuyeres 12 is normally lined with materials such as carbon blocks 19 which will withstand the severe conditions in this area. Also, a conventional cupola may be lined with material such as cast iron wear brick 20 in the charging area which is above the header 18. This cast iron wear plate is for the purpose of withstanding the severe abrasion conditions imparted by the charging operation. In the area between the tuyeres 12 and the header 18, the metal shell of the present invention is lined with fired refractory shapes in the form of blocks or tile which are formed from any suitable refractory composition.

Since the most severe conditions within the cupola are encountered in the area of the tuyeres 12, the refractory lining must be selected so as to withstand the conditions in this particular area. Therefore, a pre-fired refractory tile or block is selected which has a thermal conductivity such that the amount of refractory material remaining upon reaching equilibrium conditions will be sufficient to maintain the mechanical and structural integrity of the lining. It has been found that with a typical type of water cooled cupola in which 3" thick fired refractory blocks are placed having a thermal conductivity of 18 BTU/sq.ft./hr./in.thickness/°F., the lining will wear down in the tuyere area to an equilibrium point where there is at least about $\frac{3}{8}$ of an inch of material remaining. The amount of wear will decrease at locations remote from the tuyeres and up in the area of the header 18, there will be very little, if any, wear. This means that when equilibrium conditions are reached, there will be sufficient refractory material remaining to provide a significant degree of insulation and to insure the long term structural integrity of the lining. It should be pointed out that lining with an unfired material such as a ramming or gunning mix in the high temperature region of the tuyeres will not produce the same results as the present invention. The unfired material remains unreacted and unsintered against the metal shell because of the water cooling and thus looses its mechanical ability to remain in place on the wall after a short period of time.

The 3" thick tile with a thermal conductivity of 18 mentioned above is merely by way of example. It has been found that a thickness of about 3" is preferred but that the optimum thickness will vary according to the temperatures encountered within the cupola as a function of the material being treated, the thermal conductivity of the particular refractory material that is selected and the amount of external cooling from the water. The thermal conductivity of the refractory material which is selected may also vary. It has been found that thermal conductivities less than 15 BTU/sq.ft./hr./in. thickness/°F. at least in the area of the tuyeres is not practical. On the other hand, the conductivity may go as high as 100 such as if silicon carbide lining material is used. These limits on the conductivity of the refractory material apply only in the area of the tuyeres. The possibility of using refractory material having a different conductivity in the upper portion of the cupola will be discussed hereinafter.

The equilibrium condition which has been discussed is reached when the inside surface of the refractory lining is at a temperature about equal to the melting point of the material in the cupola. For example, the melting point of iron is about 2160° F. and when the refractory lining has worn down such that the hot face temperature is down to that point, further erosion of the refractory material will not take place. The exact temperature, of course, will vary with the melting temperature of the particular material.

At equilibrium conditions, the heat loss from the cupola to the cooling water and the surrounding air will be reduced by as much as 60% as compared to an unlined cupola. Since the heat loss has been reduced, the cupola temperature can be maintained at the proper level with significantly less coke. For example, a normal coke-to-iron ratio of 1 to 6 may be reduced to a figure of 1 to 18. Less coke results in the production of less carbon monoxide and dioxide, thus producing less air pollution and reducing the amount of air pollution control equipment that is required. Furthermore, because less coke is required and the ratio of coke-to-iron is reduced, a higher tonnage of iron can be produced in a particular cupola per unit of time.

The conventional non-lined cupola will, using cooling water, maintain a shell temperature of about 1500° F. This shell will have a relative short life, after which time it must be replaced. Refractory lining will extend this life significantly.

Figure 2:
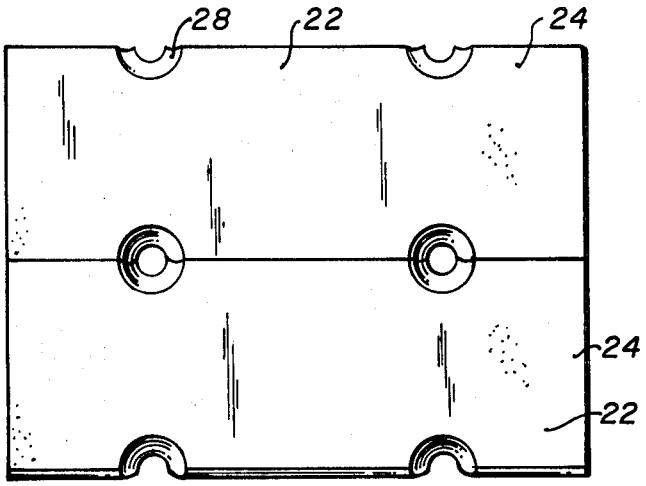
FIGS. 2, 3 and 4 illustrate the details of the refractory block or tile and the method of attaching the tile to the furnace shell.
Figure 4:
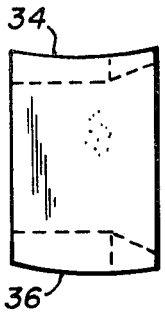
Figure 3:
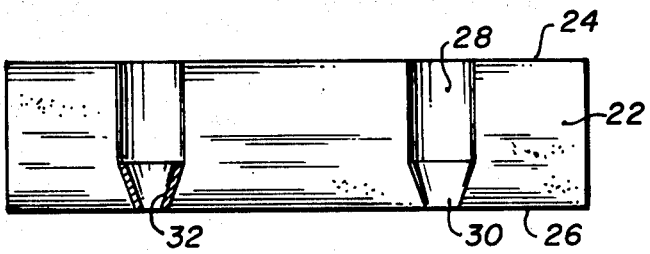

Referring now to FIGS. 2, 3 and 4, there is illustrated a typical type of refractory tile which is used in the present invention. FIG. 2 is a view of two of the tile 22 placed adjacent to each other while FIG. 3 is a side view of one of the tile illustrating the hot face 24 and the cold face 26. These two Figures illustrate the semicircular channels 28 which are formed in the sides of the tile. These channels 28 are semicylindrical extending from the hot face 24 a portion of the way through the thickness of the tile and then are tapered inwardly at 30 towards the cold face 26. As shown in FIG. 2, when two of these tiles are placed adjacent to each other, these channels mate with each other to form circular channels. These channels are for the purpose of retaining the tile on the metal subsurface by means of a tapered weld plug 32 as shown in FIG. 3. This weld plug is of the conventional type which is placed into the channel and which fits snugly into the tapered portion 30 and which is then welded to the metal subsurface to retain the tiles in position. Since the tiles must be adapted to conform to a cylindrical cupola configuration, the sides are curved as shown in FIG. 4 at 34 and 36 so that adjacent tile will mate properly with each other. After the tiles have been attached with the metalic retainers, the retainer openings are filled with refractory material.

In a modified form of the present invention, different refractory compositions are selected for different elevations in the cupola to correspond to the different temperatures encountered. For example, FIG. 1 shows refractory blocks **22*a* down in the area of the cupola near the tuyeres and refractory 22*b* in the upper portion of the cupola remote from the tuyeres. Refractory block 22*a* which is in a very high temperature region, will have a high thermal conductivity on the order of 15 to 100 as previously mentioned or even higher while the refractory block 22*b* will have a significantly lower conductivity, perhaps on the order of 0.4 to 20 BTU/sq.ft./hr./in./°F. By this technique, refractory block of relatively uniform thickness may be used and the heat loss in the upper portion of the cupola can be greatly reduced still without exceeding the temperature limit of the refractory 22*b***. In other words, this is a technique that may be used to further reduce the heat loss from the cupola while still maintaining the integrity of the refractory lining.

We claim:

1. In a water cooled furnace including a metal furnace shell and means for water cooling the exterior surface of said shell, the improvement comprising a relatively uniformly thick lining of prefired refractory blocks lining the interior surface of said shell and means mechanically attaching said refractory blocks to said shell wherein said refractory blocks have a thermal conductivity of between 15 and 100 BTU/sq.ft./hr./in./°F. and a thickness of about three inches such that a significant portion of the thickness of said refractory blocks will remain when equilibrium conditions have been reached and said refractory lining will maintain its mechanical integrity.

2. The invention set forth in claim 1 wherein said furnace is a cupola.

3. In a water cooled cupola including a metal shell and means for water cooling the exterior surface of said metal shell wherein said cupola has at least one high temperature region and at least one low temperature region vertically spaced in said cupola, the improvement comprising a relatively uniformly thick lining of prefired refractory blocks lining the interior surface of said metal shell and means mechanically attaching said refractory blocks to said shell, said refractory blocks comprising:

a. a first set of refractory blocks in the high temperature region having a thermal conductivity between 15 and 100 BTU/sq.ft./hr./in./°F. such that the interior surface of said first set of refractory blocks will be maintained at about a preselected temperature; and b. a second set of refractory blocks in the lower temperature region having thermal conductivity lower than that of said first said set of refractory blocks and between 0.4 and 20 BTU/sq.ft./hr./in./°F. such that heat conductivity through said second set of refractory blocks will be lower than through said first set of refractory blocks and such that the interior surface of said second set of refractory blocks will not exceed said preselected temperature;

whereby a significant portion of the thickness of said refractory blocks will remain when equilibrium conditions have been reached and said refractory blocks will maintain their mechanical integrity.

* * * * *